US006738257B1

(12) United States Patent
Lai

(10) Patent No.: US 6,738,257 B1
(45) Date of Patent: May 18, 2004

(54) HEAT SINK

(75) Inventor: Yaw-Huey Lai, Chung Hu (TW)

(73) Assignee: Aai-Sol Electronics, Taipei Hsien (TW)

( * ) Notice: Subject to any disclaimer, the term of this patent is extended or adjusted under 35 U.S.C. 154(b) by 0 days.

(21) Appl. No.: 10/369,566

(22) Filed: Feb. 21, 2003

(30) Foreign Application Priority Data

Dec. 2, 2002 (TW) ..... 91219438 U

(51) Int. Cl.[7] ..... H05K 7/20

(52) U.S. Cl. ..... 361/700; 361/699; 257/714; 174/15.2; 165/80.4; 165/104.26

(58) Field of Search ..... 361/699, 700, 361/704; 257/714, 715; 174/15.1, 15.2; 165/104.26, 80.4; 62/259.2

(56) References Cited

U.S. PATENT DOCUMENTS 4,910,642 A * 3/1990 Downing ..... 361/690
5,206,791 A * 4/1993 Novotny ..... 361/700
5,412,535 A * 5/1995 Chao et al. ..... 361/700
5,632,158 A * 5/1997 Tajima ..... 62/259.2
5,780,928 A * 7/1998 Rostoker et al. ..... 257/713

* cited by examiner

*Primary Examiner*—Boris Chervinsky
(74) *Attorney, Agent, or Firm*—Bacon & Thomas PLLC

(57) ABSTRACT

An improved heat sink is composed of a base member, a cover member, at least one capillary layer, a plurality of hollow columns, a plurality of cooling fins, and a predetermined amount of solder. The base member is provided with an external wall extending upwards and outwards from a peripheral fringe thereof. The cover member is provided with a skirt portion extending downwards and outwards from a peripheral fringe thereof. A vapor chamber is formed between the cover member and the base member. The capillary layer, which is mounted in the vapor chamber, includes at least one plate member and a plurality of convex portions and is spaced apart from the skirt portion at a predetermined distance. The hollow columns are connected with tile cover member and communicate with the vapor chamber. Each of the hollow columns is fitted with a capillary pipe inside. A position in which an inner periphery of the hollow column contacts a top fringe of the internal wall is spaced apart from the capillary pipe at a predetermined distance. The cooling fins are fitted around an outer periphery of the hollow columns and are spaced apart from one another at a predetermined distance. The solder fills between the skirt portion and the base member and between bottoms of the hollow columns and the cover member.

3 Claims, 7 Drawing Sheets

HEAT SINK

BACKGROUND OF THE INVENTION

1. Field of the Invention

The present invention relates generally to heat-dissipation techniques, and more particularly to a heat sink having an improved structure, which can prevent solder from being absorbed by a metal capillary wick while manufacturing the heat sink.

2. Description of the Related Art

As shown in FIG. 1 and FIG. 2, a conventional heat sink is partially composed of a top shell member 91, a bottom shell member 92, and a capillary wick 93. A vapor chamber is formed between the two shell members 91 and 92, and the capillary wick 93 is received inside the vapor chamber for effectively exchanging heat via the coexistent effect of vapor and liquid. While the two shell members 91 and 92 are connected with each other, a soldering bar 95 is disposed at seams of the two shell members 91 and 92 and is melt by heating to flow into and jam the seams so as to further interconnect the two shell members 91 and 92 tightly.

However, the aforementioned prior art still needs to be improved for some disadvantages. Specifically, the aforesaid capillary wick 93 is positioned tightly against an inner periphery of the vapor chamber at an outer peripheral fringe thereof, i.e. the capillary wick 93 is very close to the seams of the two shell members 91 and 92. Accordingly, after the solder 95 is melt, as shown in FIG. 2, the solder 95 will infiltrate the seams and then contact the capillary wick 93 to be further absorbed by the capillary wick 93, thereby causing the following disadvantages.

1. The solder is mostly absorbed by the capillary wick 93 and then fails to completely seal the seams of the two shell members 91 and 92, and thereby the heat sink is in malfunction.

2. To improve the above first disadvantage, greater amount of the solder will be used to seal the seams, but the capillary wicks 93 will partially lost capillary function because of absorbing great amount of the solder, thereby resulting in ineffective heat dissipation.

SUMMARY OF THE INVENTION

The primary objective of the present invention is to provide an improved heat sink, which seals seams between a base member and a cover member to further prevent solder from being absorbed by a capillary layer and to prevent the capillary layer from losing capillary function while manufacturing the heat sink.

The foregoing objective of the present invention is attained by the improved heat sink, which is composed of a base member, a cover member, at least one capillary layer, a plurality of hollow columns, a plurality of cooling fins, and a predetermined amount of solder. The base member is provided with an external wall extending upwards and outwards from a peripheral fringe thereof. The cover member is provided with a skirt portion extending downwards and outwards from a peripheral fringe thereof, a plurality of through holes, and a plurality of internal walls respectively extending upwards from a top side of the cover member at a peripheral fringe of the through hole. The cover member is mounted on the base member and the skirt portion is located within the external wall. A vapor chamber is formed between the cover member and the base member. The capillary layer, which is mounted in the vapor chamber, includes at least one plate member and a plurality of convex portions dividing the vapor chamber into a plurality of flow passages in communication with one another. The capillary layer is spaced apart from the skirt portion at a predetermined distance. The hollow columns are identical to the through holes in numbers and respectively have an end fitted onto the internal wall. Each of the hollow columns is fitted with a capillary pipe inside, which has a bottom end extending into the vapor chamber and connected with the capillary layer. The capillary pipe is provided with a plurality of pores at the bottom end thereof for intercommunicating the flow passages and the capillary pipes. A position in which an inner periphery of the hollow column contacts a top fringe of the internal wall is spaced apart from the capillary pipe at a predetermined distance. The cooling fins are fitted around an outer periphery of the hollow columns and are spaced apart from one another at a predetermined distance. The solder fills between the skirt portion and the base member and between bottoms of the hollow columns and tile cover member.

DETAILED DESCRIPTION OF THE INVENTION

Figure 1:
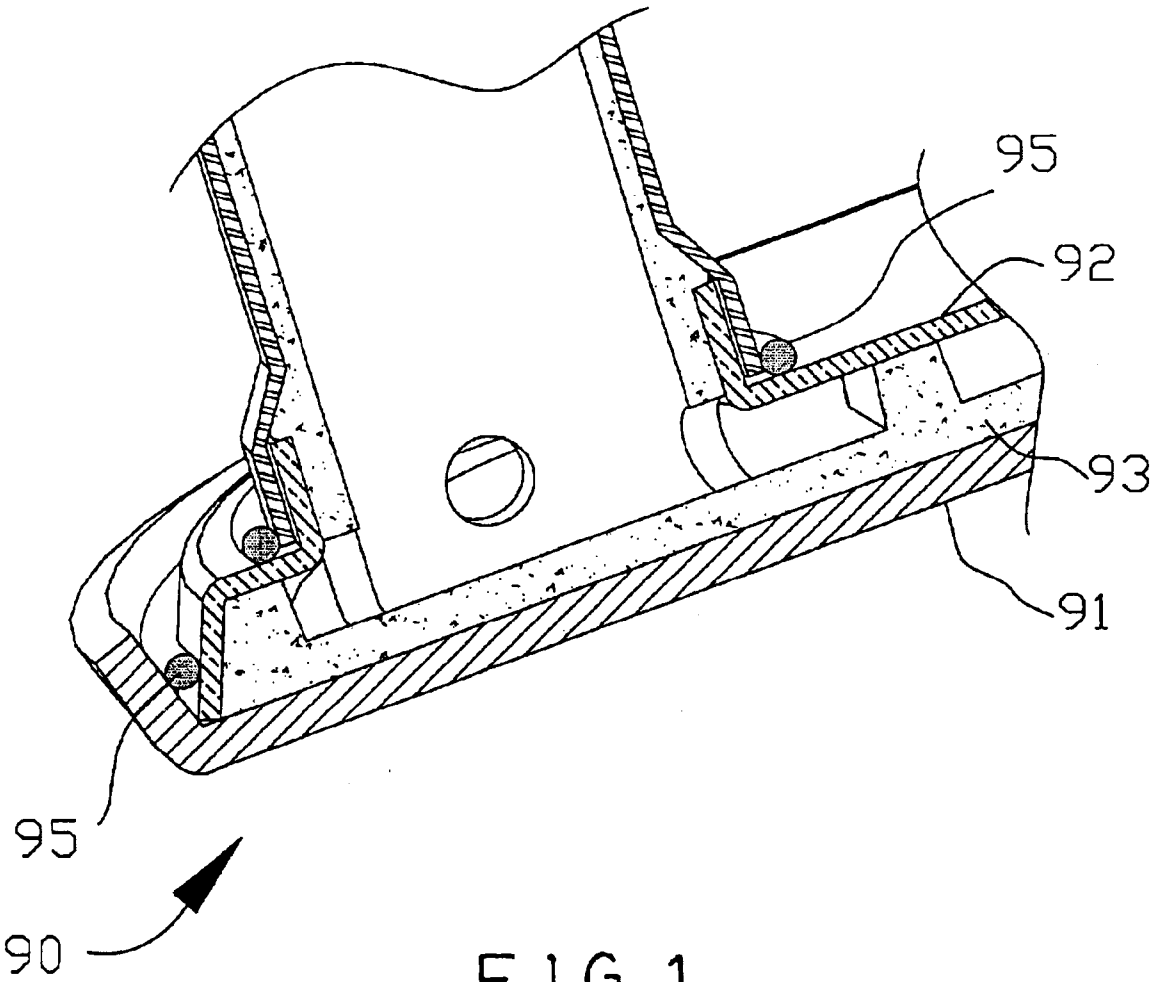
FIG. 1 PRIOR ART
FIG. 1 is a partial schematic view of a conventional heat sink before soldering.
Figure 2:
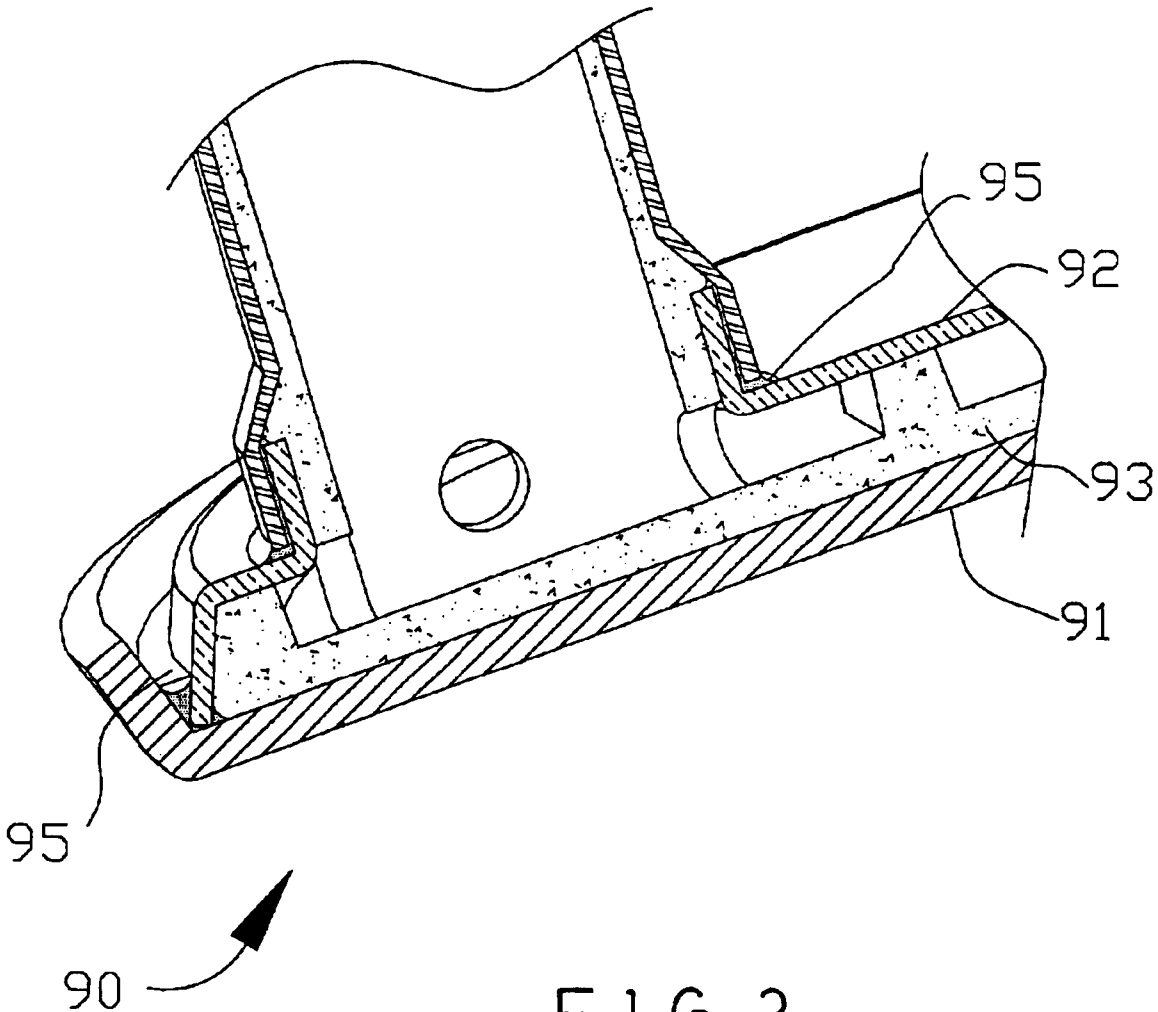
FIG. 2 PRIOR ART
FIG. 2 is a partial schematic view of the conventional heat sink after soldering.
Figure 3:
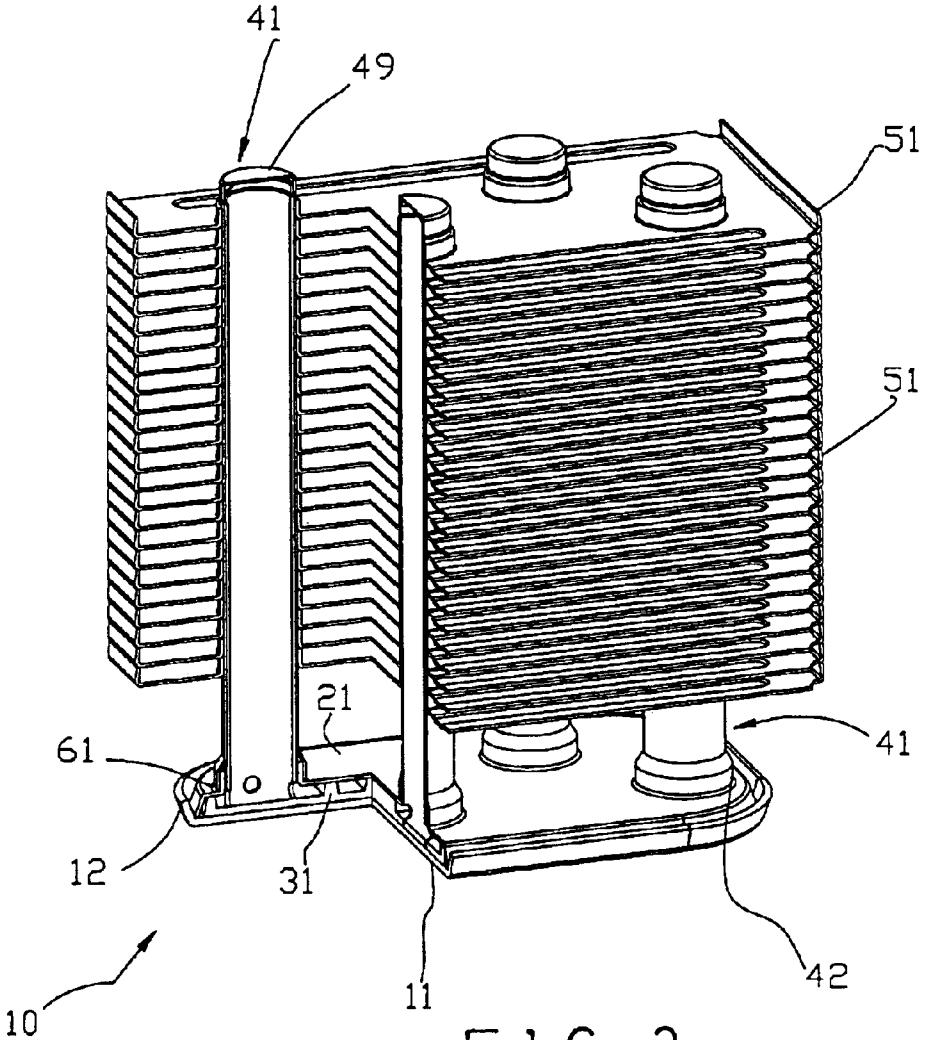
FIG. 3 is a partial sectional perspective view of a preferred embodiment of the present invention.
Figure 5:
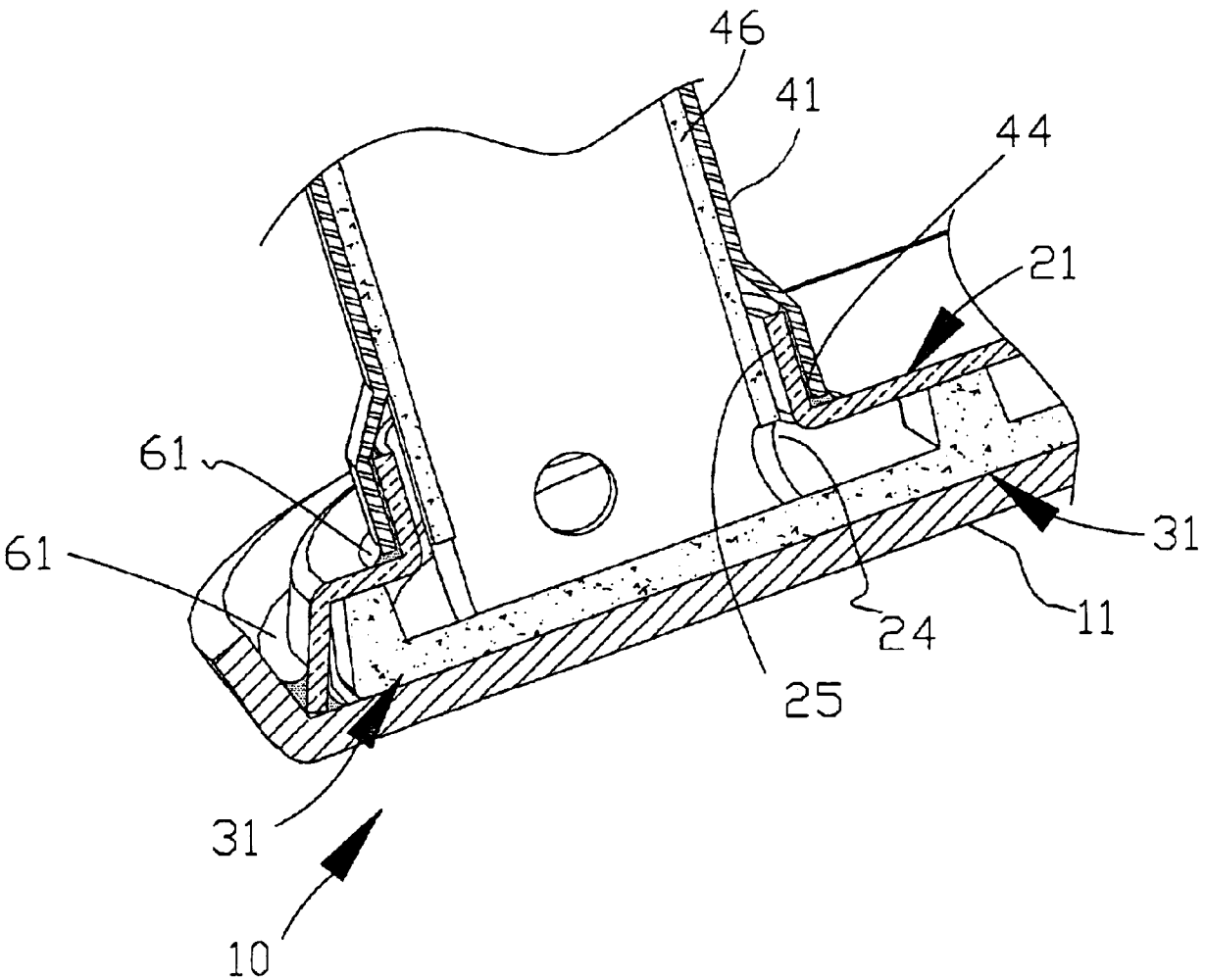
FIG. 5 is a partial sectional view of the preferred embodiment of the present invention after soldering, showing the hollow column and the cover member.
Figure 7:
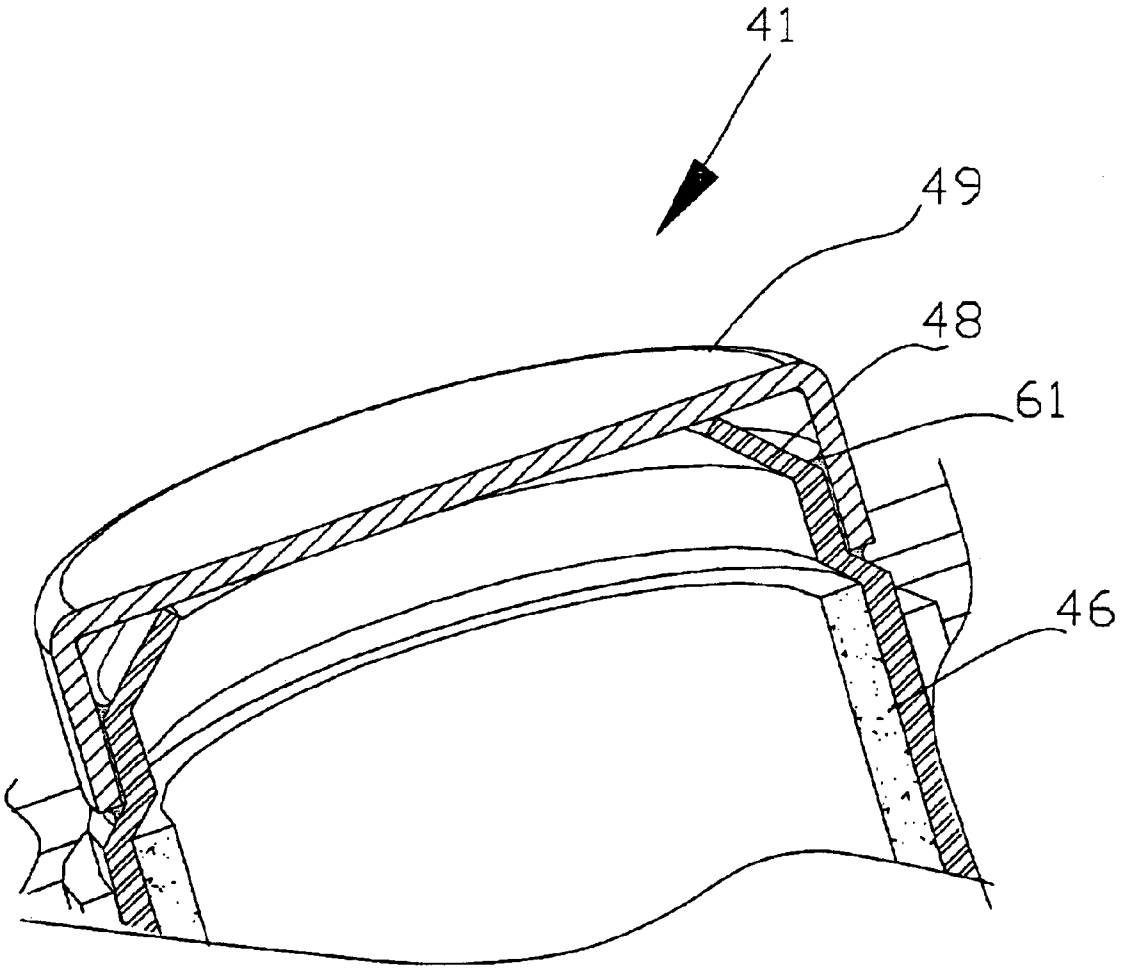
FIG. 7 is a partial sectional view of the preferred embodiment of the present invention after soldering, showing the top end of the hollow column and the cap.

Referring to FIGS. 3, 5, 7, a heal sink of a preferred embodiment of the present invention is composed of a base member 11, a cover member 21, at least one capillary layer 31, a plurality of hollow columns 41, a plurality of cooling fins 51, and a predetermined amount of solder 61.

The base member 11 includes an external wall extending upwards and outwards from a peripheral fringe thereof The cover member 21 includes a skirt portion 22 extending downwards and outwards and a plurality of through holes 24, and a plurality of annular internal walls 25 respectively extending upwards from a peripheral fringe of each the through hole 24. The cover member 21 is mounted on the base member 11 and the skirt portion 22 is located within the external wall 12 such that a vapor chamber 19 is formed between the base member 11 and the cover member 21.

The capillary layer 31, which is mounted inside the vapor chamber 19, includes a plate member 32 and a plurality of convex portions 34 located on the plate member 32 and dividing the vapor chamber 19 into a plurality of flow passages in communication with one another. The capillary layer 31 is spaced apart from the skirt portion 22 at a predetermined distance.

The hollow columns 41, which are identical to the through holes 24 in numbers, respectively include a bottom portion 42 having a larger inner diameter than that of the internal wall 25. The bottom portion 42 is provided with an opening 44 at a bottom side thereof for fitting onto the internal wall 25. Each hollow column 41 is fitted with a capillary pipe 46 inside, which has a bottom end extending into the vapor chamber 19 and connected with the capillary layer 31 and a plurality of pores 47 at the bottom end thereof for intercommunicating the capillary pipe 46 and the flow passages of the vapor chamber 19. A position in which an inner periphery of each hollow column 41 contacts a top fringe of the internal wall 25 is spaced apart from the capillary pipe 46 at a predetermined distance. Each the hollow column 41 is provided with a shoulder portion 48 extending inwards and upwards around a top end thereof on which a cap 49 is mounted. A space is formed between the cap 49 and the shoulder portion 48.

The cooling fins 51 are fitted around outer peripheries of the hollow columns 41 and are spaced apart from one another at a predetermined distance.

The solder 61 fills between the skirt portion 22 and the base portion 11, between the bottom portion 42 of the hollow column 41 and the cover member 21, and between an inner periphery of the cap 49 and an outer periphery of the hollow column 41.

Figure 4:
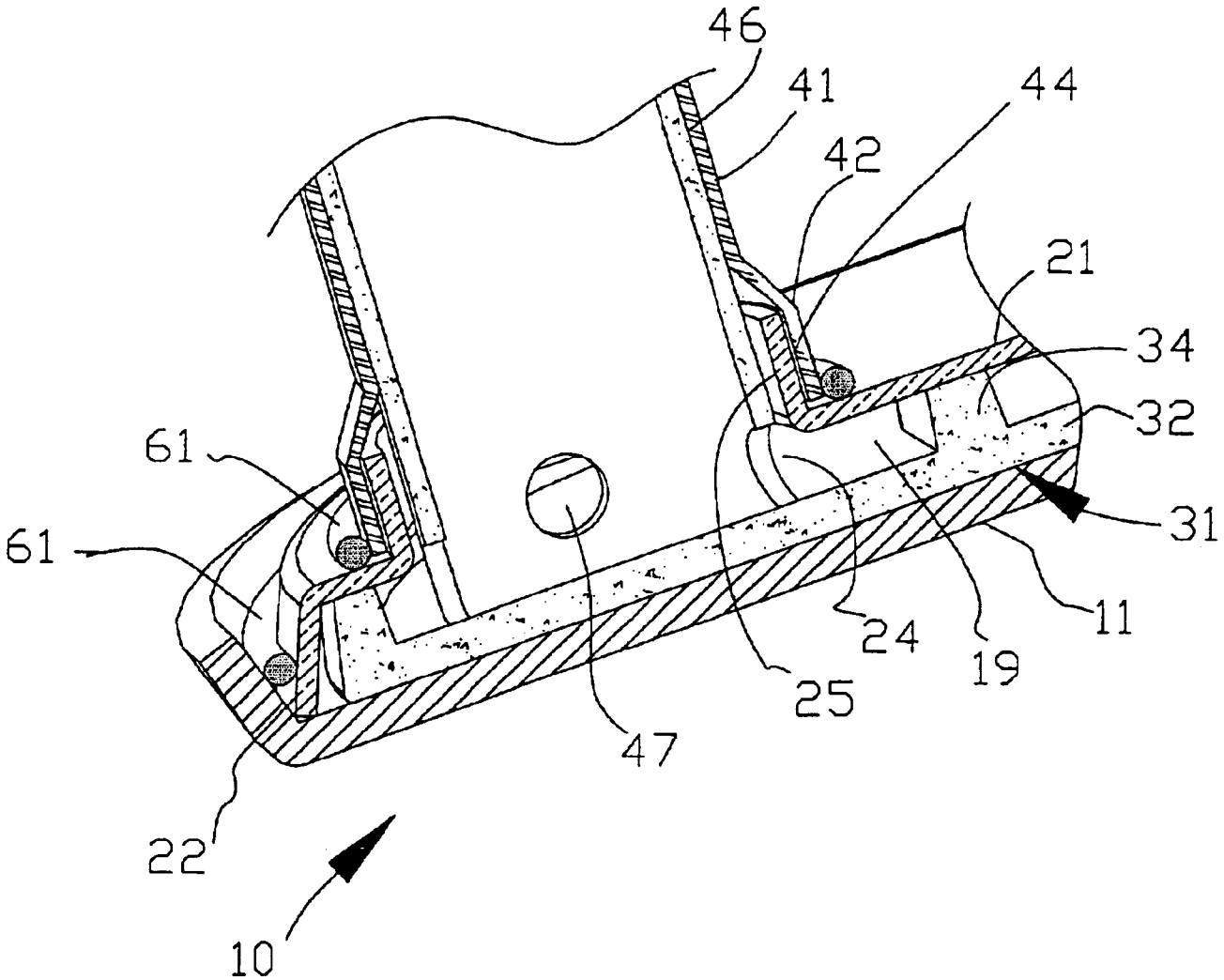
FIG. 4 is a partial sectional view of the preferred embodiment of the present invention before soldering, showing a hollow column and a cover member.

Referring to FIG. 4, the solder 61 is disposed around an outer peripheral fringe of the bottom portion 42 of the hollow column 41 and the capillary layer 31 is spaced apart from the skirt portion 22 at a predetermined distance. Referring to FIG. 5, while the heat sink is manufactured, the solder 61 is melt and flows into seams between the skirt portion 22 and the base member 11 by means of capillary action. Accordingly, the melted solder 61 doesn't contact the capillary layer 31 so as not to be absorbed by the capillary layer 31.

Figure 6:
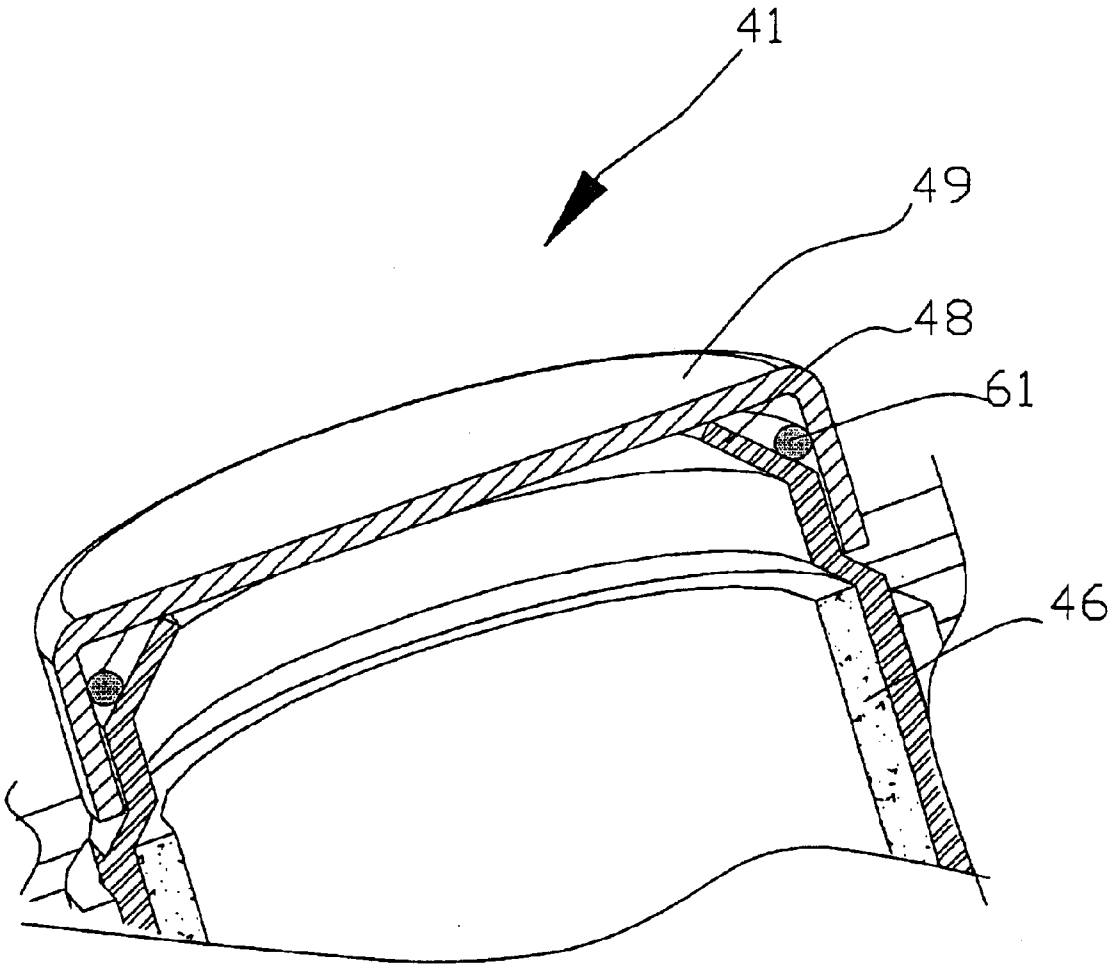
FIG. 6 is a partial sectional view of the preferred embodiment of the present invention before soldering, showing a top end of the hollow column and a cap.

Likewise, referring to FIG. 6, the space formed between the cap 49 and the shoulder portion 48 stops the melted solder 61 from flowing into the hollow column 41 by means of the capillary action. As is shown in FIG. 7, the melted solder 61 stays between the inner periphery of the cap 49 and the outer periphery of the hollow column 41 without flowing into the hollow column 41. In other words, the shoulder portion 48 of the hollow column 41 prevents the melted solder 61 from being absorbed by the capillary pipe 46 and further flowing into the hollow column 41 such that no aforementioned disadvantages of the prior art will occur in the present invention.

In conclusion, the heat sink of the present invention structurally prevents the solder 61 from contacting the capillary layer 31 and further avoids the aforesaid two drawbacks of the prior art.

What is claimed is:

1. A heat sink comprising:

a base cover having an external wall extending upwards and outwards from a peripheral fringe thereof;

a cover member having a skirt portion extending downwards and outwards from a peripheral fringe thereof, a plurality of through holes, and a plurality of internal walls respectively extending upwards from a peripheral fringe of said through hole, said cover member being mounted on said base member, said skirt portion being located within said external wall, a vapor chamber being defined between said base member and said cover member;

at least one capillary layer having at least one plate member and a plurality of convex portions located on said plate member, said capillary layer being mounted in said vapor chamber, said convex portions dividing said vapor chamber into a plurality of flow passages in communication with one another, said capillary layer being spaced apart from said skirt portion at a predetermined distance;

a plurality of hollow columns respectively having an opening at an end thereof and a capillary pipe fitted inside thereof, said hollow columns being identical to said through holes in numbers and being respectively fitted onto said internal wall at said opening thereof, each said capillary pipe having a bottom end extending into said vapor chamber and connected with said capillary layer, said capillary pipe having a plurality of pores at the bottom end thereof for intercommunicating said through holes and said flow passages, a position that an inner periphery of said hollow column contacts a top fringe of said internal wall being spaced apart from said capillary pipe at a predetermined distance;

a plurality of cooling fins fitted around outer peripheries of said hollow columns and spaced apart from one another at a predetermined distance; and a predetermined amount of solder filling between said skirt portion and said base member and between said bottom sides of said hollow columns and said cover member.

2. The heat sink as defined in claim 1, wherein said hollow columns respectively have a bottom portion at a bottom side thereof, said bottom portion having a larger diameter than that of said through hole and an opening at a bottom side thereof, each said hollow column being fitted onto said internal wall at said opening thereof.

3. The heat sink as defined in claim 2, wherein each said hollow column includes a shoulder portion extending inwards and upwards from a top end thereof, a cap being mounted tightly on the top end of said hollow column, a space being formed between said cap and said shoulder portion; wherein said solder fills between an inner periphery of said cap and an outer periphery of said hollow column.

* * * * *

UNITED STATES PATENT AND TRADEMARK OFFICE

CERTIFICATE OF CORRECTION

PATENT NO. : 6,738,257 B1
DATED : May 18, 2004
INVENTOR(S) : Yaw-Huey Lai

It is certified that error appears in the above-identified patent and that said Letters Patent is hereby corrected as shown below:

Title page,
Item [73], Assignee, correct to read -- Tai-Sol Electronics, Taipei Hsien (TW) --.

Signed and Sealed this

Eleventh Day of January, 2005

JON W. DUDAS
*Director of the United States Patent and Trademark Office*